US007211760B2

(12) United States Patent
Takiguchi et al.

(10) Patent No.: US 7,211,760 B2
(45) Date of Patent: May 1, 2007

(54) MEMBRANE SWITCH

(75) Inventors: Tsuyoshi Takiguchi, Saitama (JP); Daisuke Hiraoka, Tokyo (JP); Osamu Hirata, Tokyo (JP); Tadanao Matsumoto, Tokyo (JP); Naoki Iwao, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 0 days.

(21) Appl. No.: 11/295,220

(22) Filed: Dec. 6, 2005

(65) Prior Publication Data

US 2006/0131158 A1 Jun. 22, 2006

(30) Foreign Application Priority Data

Dec. 21, 2004 (JP) ..... 2004-369043

(51) Int. Cl.
*H01H 1/10* (2006.01)

(52) U.S. Cl. ..... 200/512

(58) Field of Classification Search ..... 200/512
See application file for complete search history.

(56) References Cited

U.S. PATENT DOCUMENTS 5,401,922 A * 3/1995 Asta ..... 200/5 A
6,114,640 A * 9/2000 Oddo et al. ..... 200/61.27
6,541,724 B2 * 4/2003 Nozawa et al. ..... 200/517
6,734,382 B2 * 5/2004 Arai et al. ..... 200/512
6,967,299 B2 * 11/2005 Howie et al. ..... 200/512

FOREIGN PATENT DOCUMENTS

JP 5-217463 A 8/1993

* cited by examiner

*Primary Examiner*—K. Lee
*Assistant Examiner*—Lheiren Mae A. Anglo
(74) *Attorney, Agent, or Firm*—Frishauf, Holtz, Goodman & Chick, P.C.

(57) ABSTRACT

A membrane switch which can be opened and closed with a small pushing load. A fixed contact point 4 is formed on one surface of a first sheet 3. Flexible movable contact points 7 opposed to the fixed contact point 4 via a space in a manner movable to and way from the fixed contact point 4 are formed on one surface of a second sheet 6, opposed to the one surface of the first sheet 3. Insulators are arranged on the flexible movable contact points at locations except for the locations of push portions of the flexible movable contact points 7.

18 Claims, 10 Drawing Sheets

MEMBRANE SWITCH

BACKGROUND OF THE INVENTION

1. Field of the Invention

The present invention relates to a membrane switch, and more particularly to a membrane switch capable of turning on a switch with a small pushing force.

2. Description of the Related Art

Conventionally, a membrane switch is known which includes a lower film, a plurality of lower electrodes, an upper film, a plurality of upper electrodes, and a spacer film (Japanese Laid-Open Patent Publication (Kokai) No. H05-217463 (Paragraph numbers [0002] to [0010], FIG. 3).

The lower electrodes are formed at equal space intervals on the upper surface of the lower film.

The upper film is opposed to the lower film via the spacer film.

The upper electrode are formed at equal space intervals on the lower surface of the upper film.

A plurality of through holes are formed in the spacer film interposed between the upper film and the lower film. Each through hole accommodates a pair of a lower electrode and an upper electrode opposed to each other.

In this membrane switch, when a push portion of the upper film is pushed, an upper electrode under the push portion is brought into contact with a lower electrode associated therewith to turn on the switch.

The size of the push portion of the upper film is larger than that of the upper electrode. A gap between the lower electrode and the upper electrode is relatively large so as to prevent the lower electrode and the upper electrode from being erroneously brought into contact with each other when the membrane switch is bent.

In the above-described membrane switch, to bring an upper electrode into contact with a lower electrode associated therewith, it is required to push a small push portion with a fingertip to largely bend the push portion, which necessitates a large pushing load. This makes the membrane switch low in operability.

SUMMARY OF THE INVENTION

The present invention has been made in view of these circumstances, and an object thereof is to provide a membrane switch which can be turned on and off with a small pushing load.

To solve the above problem, the present invention provides a membrane switch comprising, a first sheet having one surface, a fixed contact point formed on the one surface of the first sheet, a second sheet opposed to the one surface of the first sheet and having one surface, a flexible movable contact point formed on the one surface of the second sheet such that the flexible movable contact point is opposed to the fixed contact point via a space in a manner movable to and way from the fixed contact point, the flexible movable contact point having a push portion, and an insulator provided on the flexible movable contact point, at a location except for the push portion of the flexible movable contact point, or on the fixed contact point, at a location opposed to the location.

According to this membrane switch, an insulator is disposed on a flexible movable contact point, at a location except for a push portion of the flexible movable contact point, or on a fixed contact point, at a location opposed to the location, and hence there is no need to provide a large gap between the flexible movable contact point and the fixed contact point, for insulation therebetween. Therefore, the membrane switch according to the present invention can be turned on and off with a small pushing load almost without any erroneous operation.

Preferably, the insulator is formed by printing.

Preferably, the insulator has a thickness equal to or smaller than 70 μm.

The above and other objects, features and advantages of the present invention will become more apparent from the following detailed description taken in conjunction with the accompanying drawings.

DETAILED DESCRIPTION OF THE PREFERRED EMBODIMENTS

Hereinafter, embodiments of the present invention will be described in detail with reference to the drawings.

Figure 1:
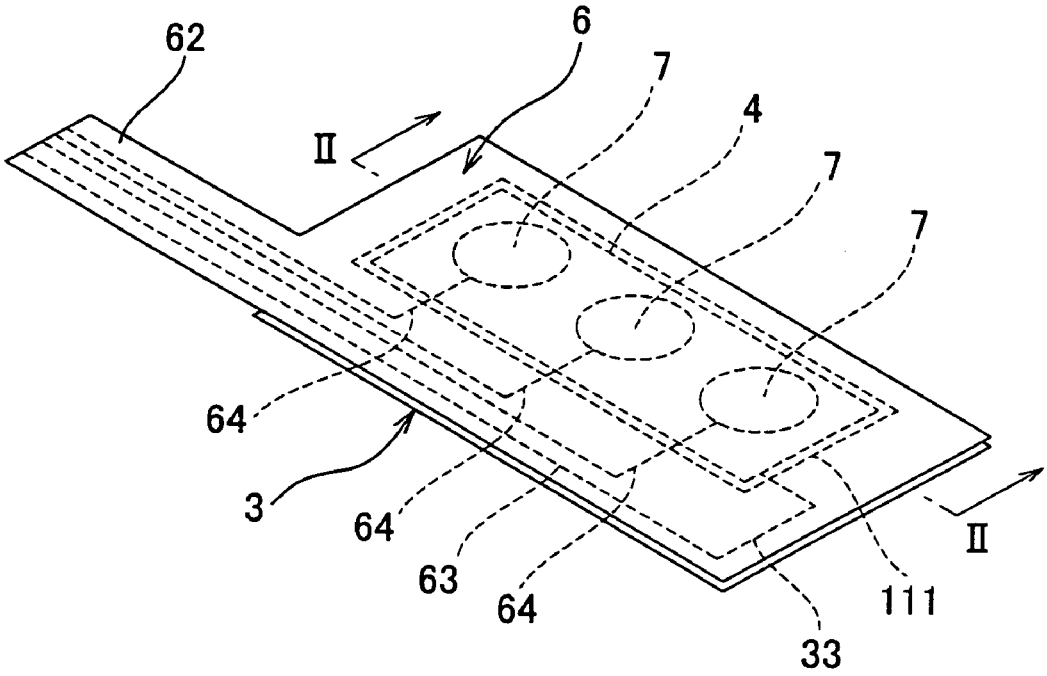
FIG. 1 is a perspective view of a membrane switch according to a first embodiment of the present invention.
Figure 2:
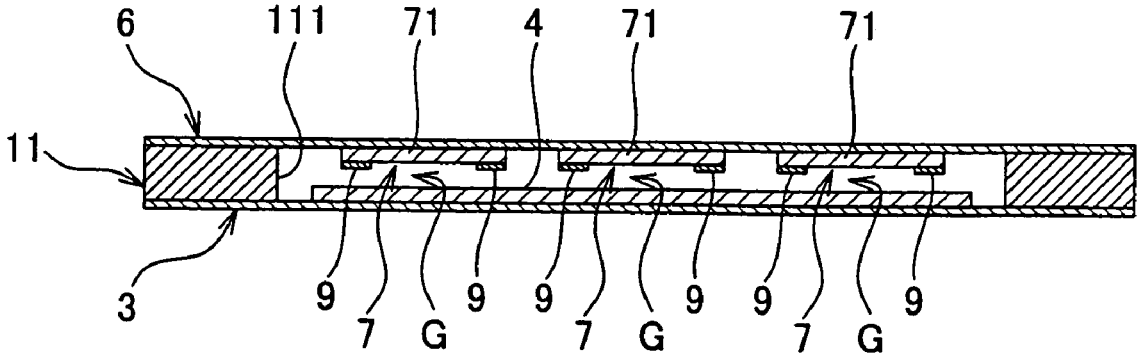
FIG. 2 is a cross-sectional view taken on line II—II of FIG. 1.
Figure 3:
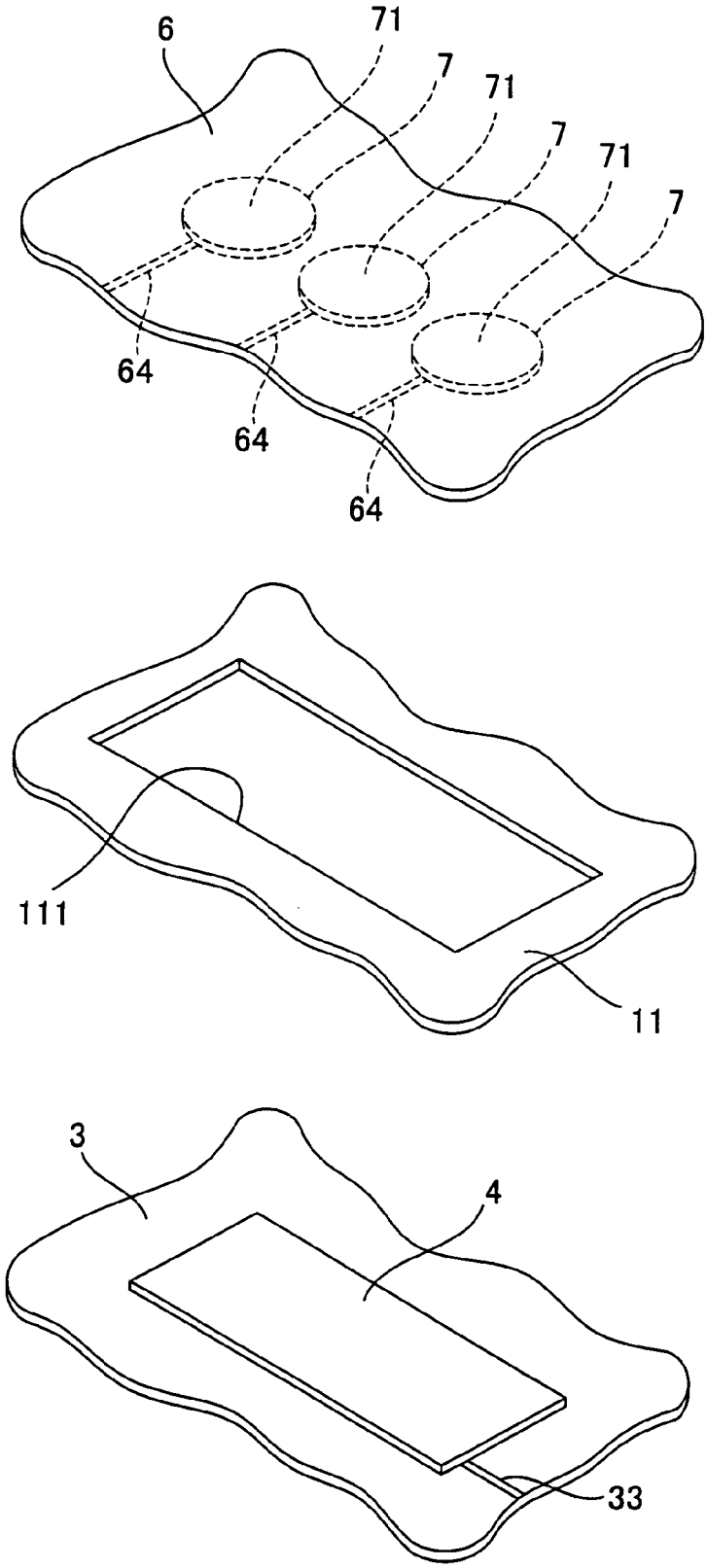
FIG. 3 is an exploded perspective view of an operating section of the membrane switch shown in FIG. 1.
Figure 4:
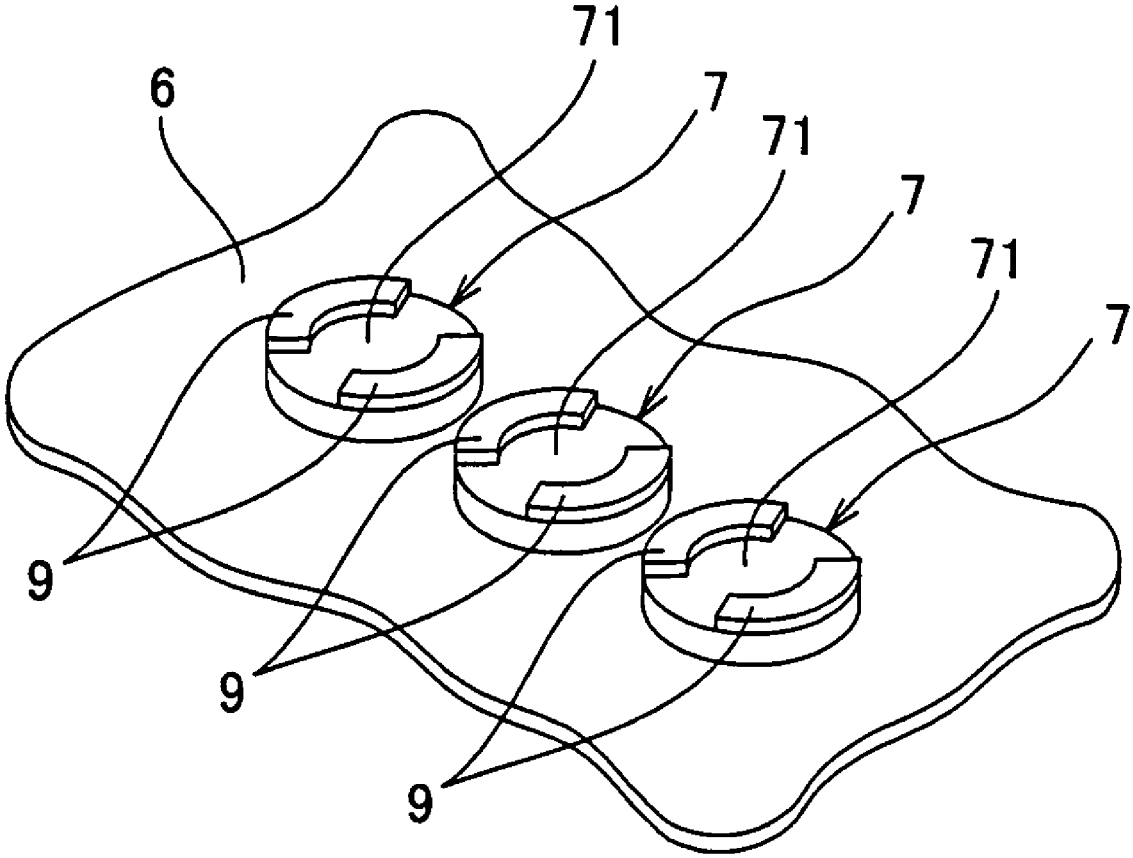
FIG. 4 is a perspective view of a second sheet appearing in FIG. 3, in a state presented in an inverted position.

FIG. 1 is a perspective view of a membrane switch according to a first embodiment of the present invention; FIG. 2 is a cross-sectional view taken on line II—II of FIG. 1; FIG. 3 is an exploded perspective view of an operating section of the membrane switch shown in FIG. 1; and FIG. 4 is a perspective view of a second sheet appearing in FIG. 3, in a state presented in an inverted position.

As shown in FIGS. 1 to 3, the membrane switch is comprised of a first sheet 3, a fixed contact point 4, a second sheet 6, flexible movable contact points 7, insulators 9, and a spacer 11.

As a material for the first sheet 3, there is suitably employed a PET sheet, for example. The first sheet 3 has an upper surface (one surface) formed with a common conductive path 33. The common conductive path 33 has one end connected to the fixed contact point 4, and the other end connected to a common electrode 63, referred to hereinafter, via a via hole or a through hole, not shown, which is formed through the spacer 11.

The fixed contact point 4 is formed on the upper surface of the first sheet 3. As a material for the fixed contact point 4, there is suitably employed a carbon, for example. The fixed contact point 4 and the common conductive path 33 are formed by printing.

The second sheet 6 is opposed to the first sheet 3. The second sheet 6 has a tail portion 62. As a material for the second sheet 6, there is suitably employed a PET sheet, for example. The second sheet 6 has the common electrode 63 formed on one end of a lower surface thereof. The common electrode 63 has one end connected to the common conductive path 33, and the other end extending to a tail end of the tail portion 62. Further, the second sheet 6 has three signal conductive paths 64 formed on the lower surface thereof. Each of the signal conductive paths 64 has an end connected to associated one of the flexible movable contact points 7, and the other end extending to the tail end of the tail portion 62. The tail portion 62 is connected to a device, not shown.

The three flexible movable contact points 7 are formed at equal space intervals on the lower surface of the second sheet 6. The flexible movable contact points 7 are opposed to the fixed contact point 4 via a gap (space) G in a manner movable toward and away from the fixed contact point 4. As a material for the flexible movable contact points 7, there is suitable employed a carbon, for example. The flexible movable contact points 7, the common electrode 63, and the signal conductive paths 64 are formed by printing.

As shown in FIG. 4, two insulators 9 are formed on each flexible movable contact point 7, at locations except for a push portion 71. The insulators are formed by printing to have a thickness of 50 μm. As a material for the insulators, there is suitably employed e.g. a resist used for a photoresist.

As shown in FIGS. 2 and 3, the spacer 11 is interposed between the first sheet 3 and the second sheet 6 so as to hold the fixed contact point 4 at an approximately uniform distance from the flexible movable contact points 7. The spacer 11 has a hole 111. The hole 111 collectively accommodates the one fixed contact point 4 and the three flexible movable contact points 7. As a material for the spacer 11, a double-sided tape is suitably employed.

By forming the insulators 9 on each flexible movable contact point 7, at locations except for a central portion thereof, the flexible movable contact point 7 and the fixed contact point 4 are opposed to each other with a small distance corresponding to the thickness of each insulator. As a result, it is possible to bend the flexible movable contact point 7 with a small pushing load to thereby bring the same into contact with the fixed contact point 4. On the other hand, since the insulators 9 are formed on each flexible movable contact point 7, the flexible movable contact points 7 are not brought into contact with the fixed contact point 4 even when the whole membrane switch is bent.

Next, a description will be given of operation of the membrane switch according to the first embodiment.

Figure 5:
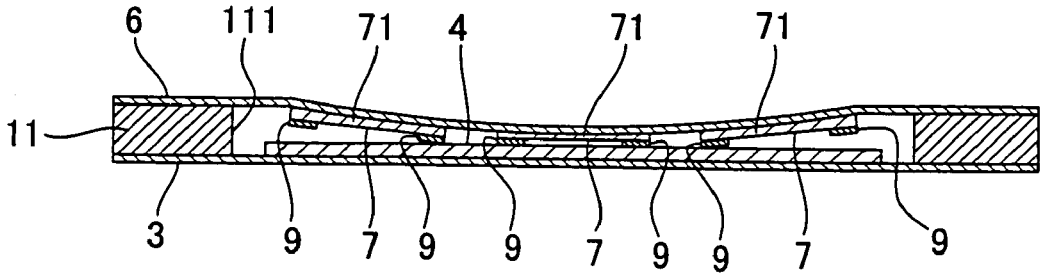
FIG. 5 is a cross-sectional view of the FIG. 1 membrane switch, in a state in which a flexible movable contact point located in the center of the membrane switch is pushed.
Figure 6:
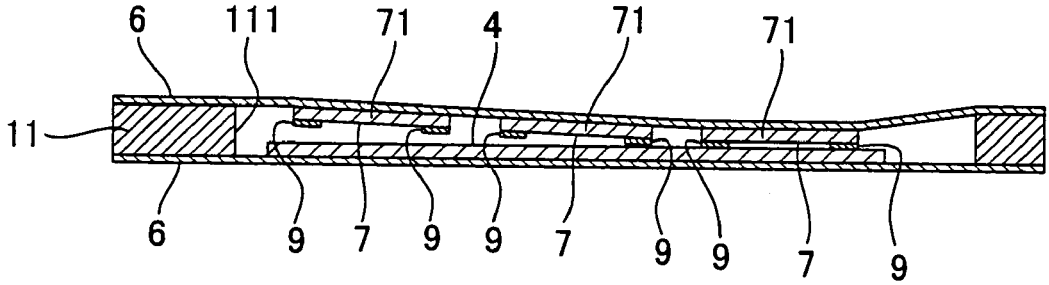
FIG. 6 is a cross-sectional view of the FIG. 1 membrane switch, in a state in which a flexible movable contact point located at a right-side end of the membrane switch is pushed.

FIG. 5 is a cross-sectional view of the FIG. 1 membrane switch, in a state in which a flexible movable contact point located in the center of the membrane switch is pushed, and FIG. 6 is a cross-sectional view of the FIG. 1 membrane switch, in a state in which a flexible movable contact point located at a right-side end of the membrane switch is pushed.

As shown in FIG. 5, when one of the three flexible movable contact points 7, located in the center of the membrane switch, is pushed with a finger via the second sheet 6, the second sheet 6 is bent to bring the insulators 9 on the flexible movable contact point 7 into abutment with the fixed contact point 4, whereby the downward movement of the flexible movable contact point 7 is stopped. At this time, the flexible movable contact point 7 located in the center of the membrane switch is approximately parallel to the fixed contact point 4.

When the flexible movable contact point 7 located in the center of the membrane switch is further pushed from the FIG. 5 state, the flexible movable contact point 7 is bent to bring the push portion 71 of the flexible movable contact point 7 into contact with the fixed contact point 4, whereby the switch is closed i.e. turned on.

When the finger is released from the flexible movable contact point 7, the flexible movable contact point 7 is moved away from the fixed contact point 4 by the respective restoring forces of the flexible movable contact point 7 and the second sheet 6, whereby the switch is turned off, and the insulators 9 are moved away from the fixed contact point 4.

Referring to FIG. 6, when one of the flexible movable contact points 7 at the right-side end of the membrane switch is pushed with a finger via the second sheet 6 to thereby bring the same into contact with the fixed contact point 4, a pushing load necessary for bringing the insulators 9 arranged on the flexible movable contact point 7 at the right-side end of the membrane switch into contact with the fixed contact point 4 is slightly larger than a pushing load necessary for bringing the insulators 9 arranged on the flexible movable contact point 7 at the center of the membrane switch into contact with the fixed contact point 4. However, since a pushing load necessary for finally bringing the flexible movable contact point 7 at the right-side end of the membrane switch into contact with the fixed contact point 4 is dependent on the thickness and the size of the flexible movable contact point 7, the pushing load hardly varies with the position where the flexible movable contact point 7 is disposed.

Next, a description will be given of the operation of the insulators 9 performed when the membrane switch is bent.

Figure 7:
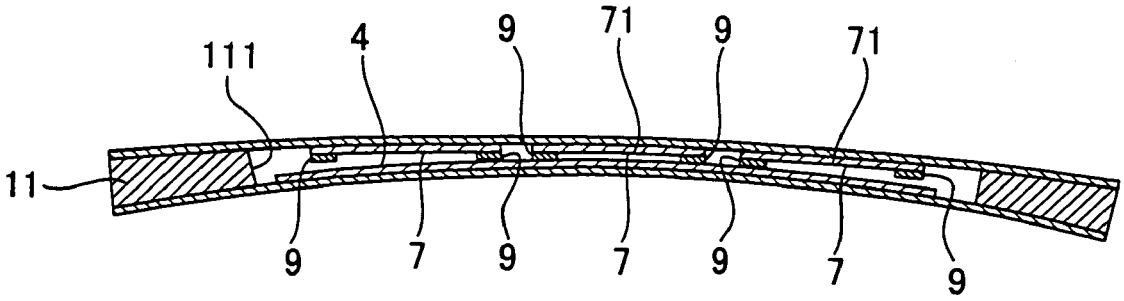
FIG. 7 is a cross-sectional view of the FIG. 1 membrane switch, in a bent state.

FIG. 7 is a cross-sectional view of the FIG. 1 membrane switch, in a bent state.

As shown in FIG. 7, when the membrane switch is bent, the distance between the first sheet 3 and the second sheet 6 is reduced, whereby the flexible movable contact point 7 in the center of the membrane switch is moved toward the fixed contact point 4. However, the insulators 9 formed on the flexible movable contact point 7 in the center of the membrane switch prevent the flexible movable contact point 7 from being brought into direct contact with the fixed contact point 4. This makes it possible to prevent the membrane switch from performing an erroneous operation.

Figure 8:
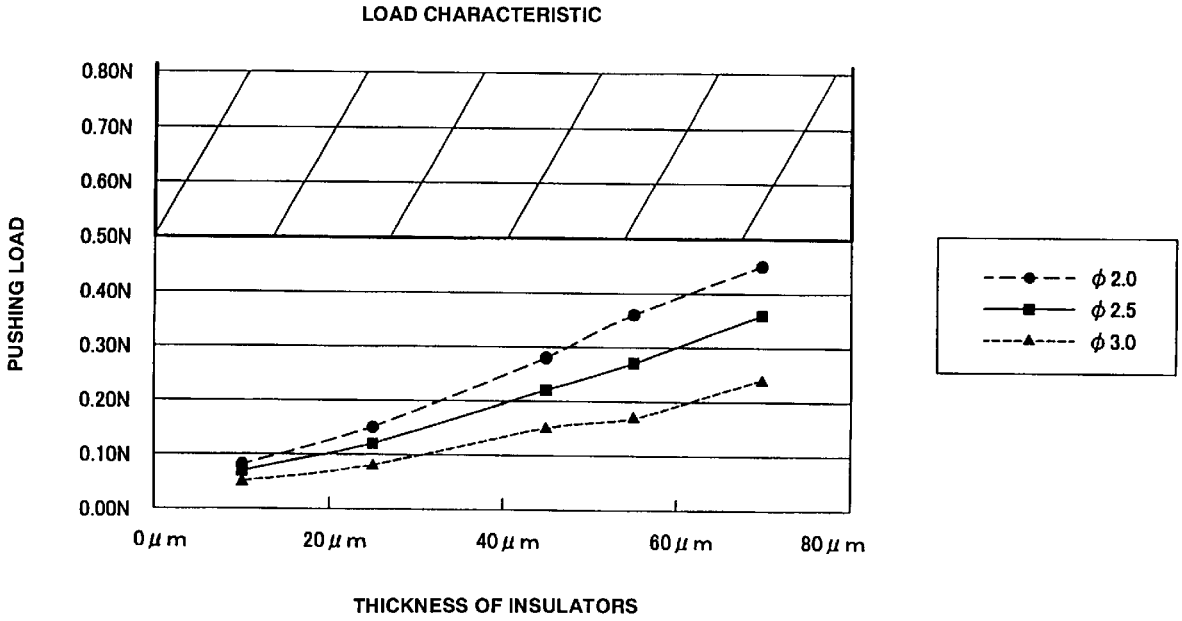
FIG. 8 is a graph showing the relationship between the thickness of insulators of the FIG. 1 membrane switch and a pushing load.

FIG. 8 is a graph showing the relationship between the thickness of the insulators of the membrane switch shown in FIG. 1 and the pushing load.

In the graph shown in FIG. 8, the horizontal axis represents the thickness of the insulators, and the vertical axis represents the pushing load. A hatched area illustrated in FIG. 8 indicates the pushing load on the conventional membrane switch.

There are shown three kinds of dots in FIG. 8. Out of the dots, circular dots indicate data of a membrane switch having flexible movable contact points 7 with a diameter of 2.0 cm; square dots indicate data of a membrane switch having flexible movable contact points 7 with a diameter of 2.5 cm; and triangular dots indicate data of a membrane switch having flexible movable contact points 7 with a diameter of 3.0 cm.

It was measured how the pushing load changed with respect to the change (10 μm to 70 μm) in the thickness of the insulators 9 of the three membrane switches that have flexible movable contact points 7 with different diameters.

As shown in FIG. 8, the pushing loads required for the operations of the membrane switches according to the present embodiment were all smaller than a pushing load required for the operation of the conventional membrane switch.

Further, as is apparent from FIG. 8, the pushing load decreases as the thickness of the insulators 9 is reduced.

As described above, the switch according to the first embodiment can be turned on with a smaller pushing load than the conventional one.

Further, e.g. when the membrane switch is bent, it is possible to prevent an erroneous operation of the membrane switch.

Further, since the insulators 9 are arranged on the flexible movable contact points 7, it is possible to manage the distance between the flexible movable contact points 7 and the fixed contact point 4 with accuracy. In contrast, when the insulators 9 are formed at locations other than the flexible movable contact points 7, such as locations ranging from the peripheries of the respective flexible movable contact points 7 to the second sheet 6, or locations on the second sheet 6, the insulators 9 can be overlaid upon a conductor pattern formed on the second sheet 6. When the insulators 9 are overlaid upon the conductor pattern, the distance between the flexible movable contact points 7 and the fixed contact point 4 cannot be managed with accuracy due to the thickness of the conductor pattern.

Figure 9:
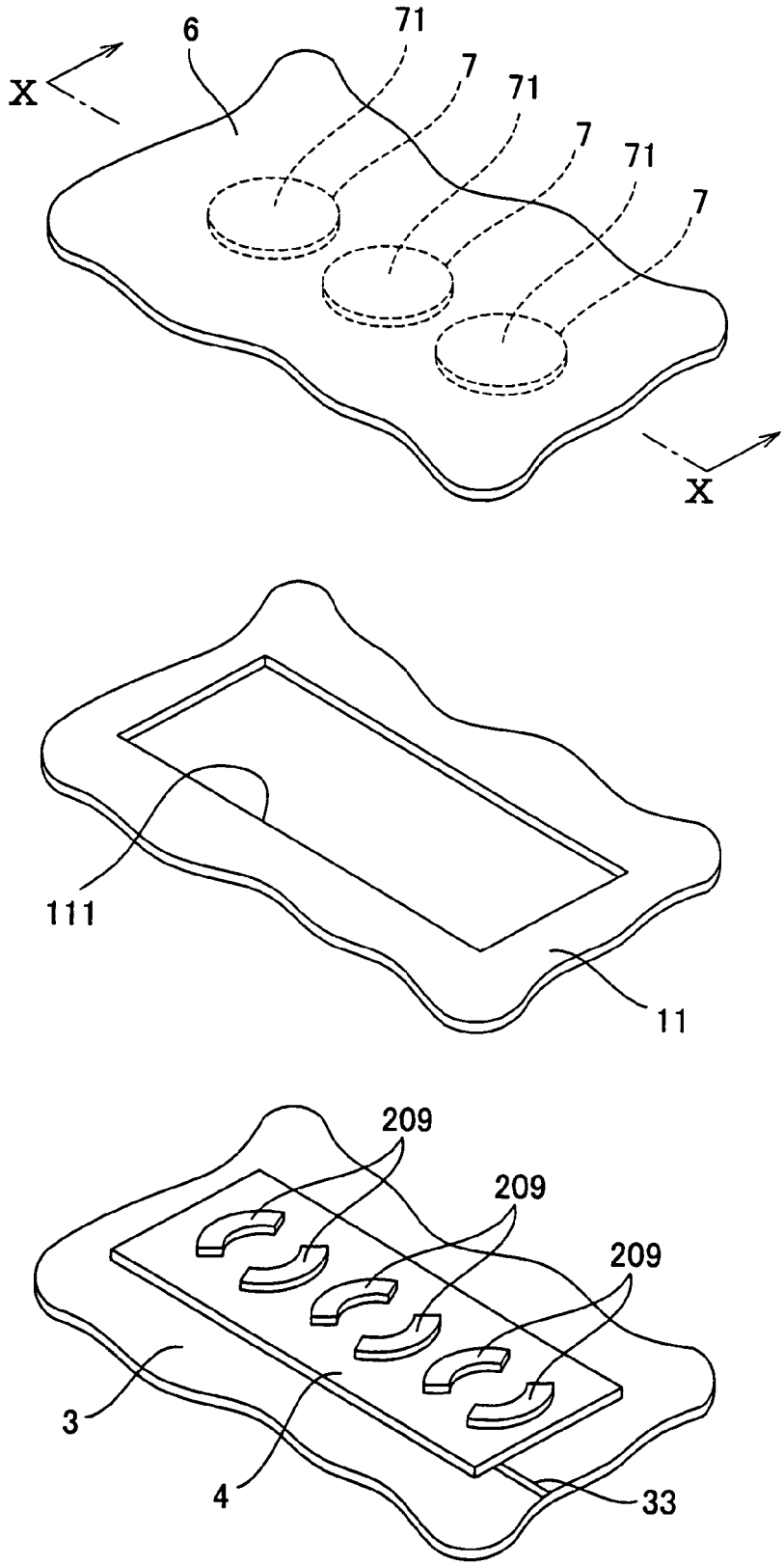
FIG. 9 is an exploded perspective view of an operating section of a membrane switch according to a second embodiment of the present invention.
Figure 10:
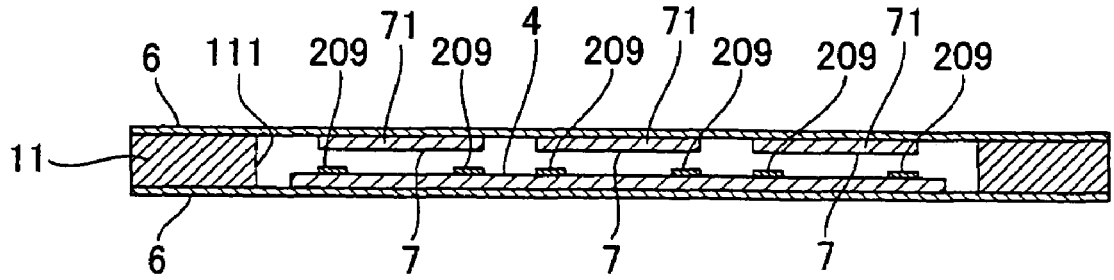
FIG. 10 is a cross-sectional view taken on line X—X of FIG. 9.

FIG. 9 is an exploded perspective view of an operating section of a membrane switch according to a second embodiment of the present invention, and FIG. 10 is a cross-sectional view taken on line X—X of FIG. 9.

Component parts identical to those of the membrane switch according to the first embodiment are designated by identical reference numerals, and detailed description thereof is omitted, while only main component parts different in construction from the first embodiment will be described hereinafter.

Although in the membrane switch according to the first embodiment, the insulators 9 are formed on the flexible movable contact points 7, in the membrane switch according to the second embodiment, insulators 209 are formed on the fixed contact point 4, as shown in FIGS. 9 and 10. The insulators 209 are arranged on the fixed contact point 4, at locations opposed to the respective flexible movable contact points 7 except for locations opposed to the push portions 71.

According to the second embodiment, it is possible to obtain the same advantageous effects as provided by the first embodiment.

Figure 11:
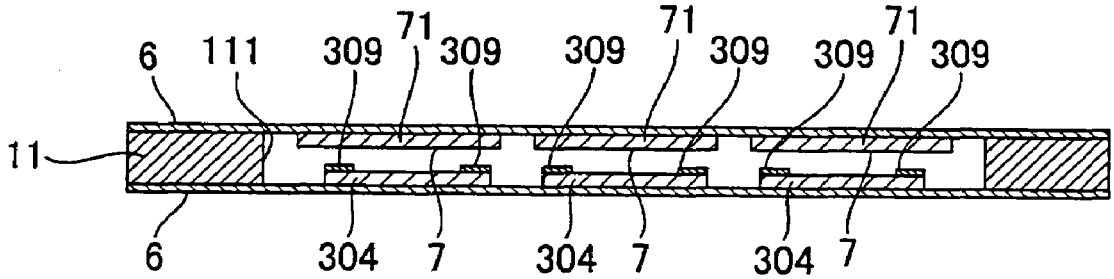
FIG. 11 is a cross-sectional view of a membrane switch according to a third embodiment of the present invention.

FIG. 11 is a cross-sectional view of a membrane switch according to a third embodiment of the present invention.

Component parts identical to those of the membrane switch according to the first embodiment are designated by identical reference numerals, and detailed description thereof is omitted, while only main component parts different in construction from the first embodiment will be described hereinafter.

As shown in FIG. 11, in the third embodiment, there are three fixed contact points 304 formed on the first sheet 3 such that they are opposed to the flexible movable contact points 7, respectively.

Two insulators 309 are formed on each fixed contact point 304. The insulators 309 are opposed to the peripheral portion of each flexible movable contact point 7.

According to the third embodiment, it is possible to obtain the same advantageous effects as provided by the first embodiment.

Figure 12:
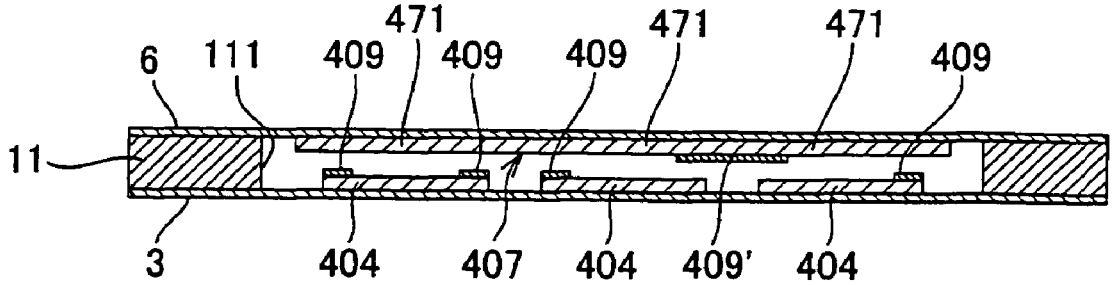
FIG. 12 is a cross-sectional view of a membrane switch according to a fourth embodiment of the present invention.

FIG. 12 is a cross-sectional view of a membrane switch according to a fourth embodiment of the present invention.

Component parts identical to those of the membrane switch according to the first embodiment are designated by identical reference numerals, and detailed description thereof is omitted, while only main component parts different in construction from the first embodiment will be described hereinafter.

Although in the membrane switch according to the first embodiment, the three flexible movable contact points 7 are formed on the second sheet 6, in the fourth embodiment, only one flexible movable contact point 407 is formed on the second sheet 6, as shown in FIG. 12.

Three fixed contact points 404 are opposed to the one flexible movable contact point 40.

Insulators 409 are formed on the fixed contact points 404. The locations of the insulators 409 are the same as those of the insulators 304 of the membrane switch according to the third embodiment.

An insulator 409' is formed on the flexible movable contact point 407. The insulator 409' prevents two push portions 471 arranged on opposite sides thereof from being brought into contact with two of the fixed contact points 404 simultaneously.

According to the fourth embodiment, it is possible to obtain the same advantageous effects as provided by the first embodiment.

Figure 13:
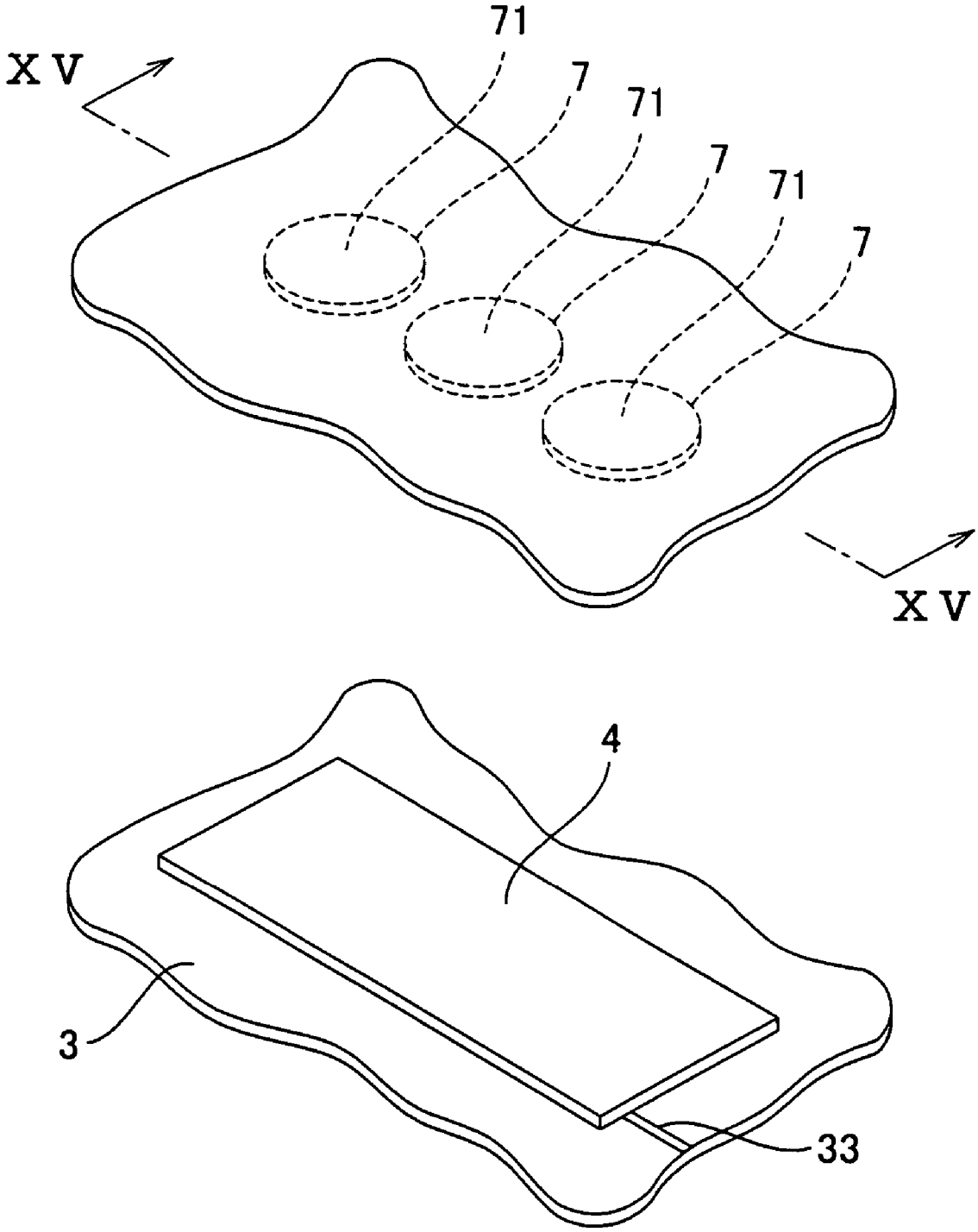
FIG. 13 is an exploded perspective view of an operating section of a membrane switch according to a fifth embodiment of the present invention.
Figure 14:
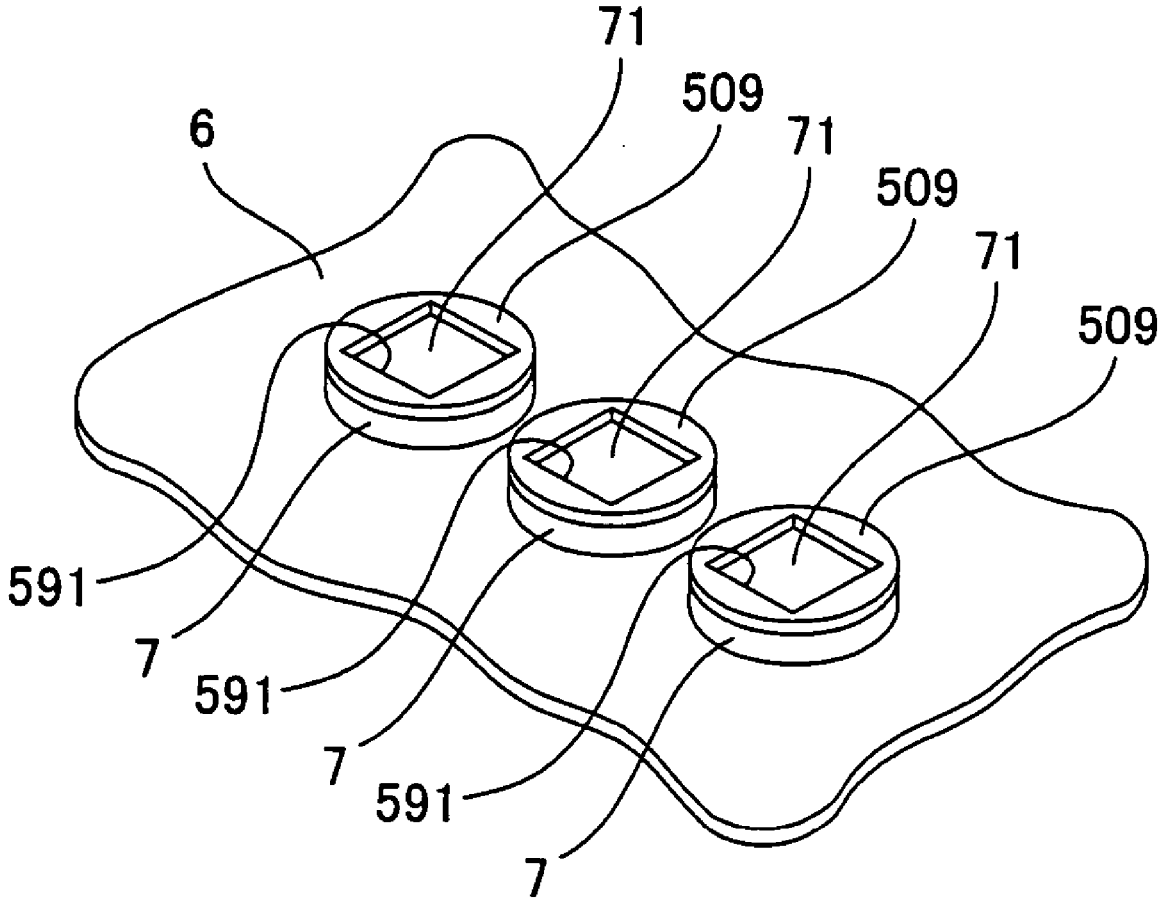
FIG. 14 is a perspective view of a second sheet appearing in FIG. 13, in a state presented in an inverted position.
Figure 15:
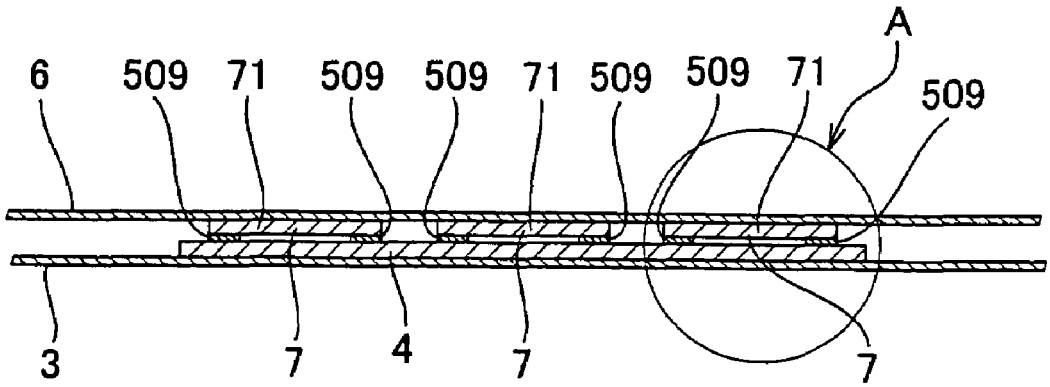
FIG. 15 is a cross-sectional view taken on line XV—XV of FIG. 13.
Figure 16:
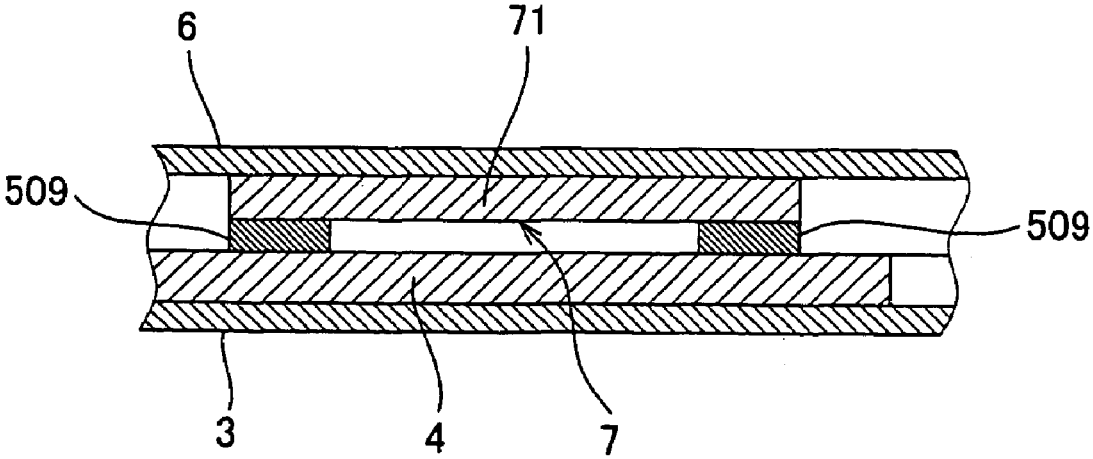
FIG. 16 is an enlarged view of part A appearing in FIG. 15.

FIG. 13 is an exploded perspective view of an operating section of a membrane switch according to a fifth embodiment of the present invention; FIG. 14 is a perspective view of the second sheet shown in FIG. 13, in a state presented in an inverted position; FIG. 15 a cross-sectional view taken on line XV—XV of FIG. 13; and FIG. 16 is an enlarged view of part A appearing in FIG. 15.

Component parts identical to those of the membrane switch according to the first embodiment are designated by identical reference numerals, and detailed description thereof is omitted, while only main component parts different in construction from the first embodiment will be described hereinafter.

Although in the first embodiment, the insulators 9 are formed on parts of the peripheral portion of the flexible movable contact points 7, in the fifth embodiment, insulators 509 are formed along the whole peripheries of the respective flexible movable contact points 7, as shown in FIGS. 13 to 16. The insulators 509 each have a square opening 591.

As described above, in the fifth embodiment, since the insulators 509 cover the whole peripheries of the respective flexible movable contact points 7, the insulators 509 have higher insulating properties than those of the insulators in the above-described embodiments when the membrane switch is bent. For this reason the spacer 11 is omitted in the fifth embodiment. As a result, according to the fifth embodiment, there is no need to push the second sheet 6 with a large pushing load, thereby making it possible to further reduce the pushing load on the flexible movable contact points 7.

It is further understood by those skilled in the art that the foregoing are the preferred embodiments of the present invention, and that various changes and modification may be made thereto without departing from the spirit and scope thereof.

What is claimed is:

1. A membrane switch comprising:

a first sheet;

at least one fixed contact point provided on a surface of said first sheet;

a second sheet opposed to said first sheet;

a spacer which is provided between the first sheet and the second sheet, and which has a hole that exposes the fixed contact point;

at least one flexible movable contact point which: (i) is provided on a surface of said second sheet so as to be located entirely within the hole and so as to be opposed to said fixed contact point via a space, (ii) is movable toward and away from said fixed contact point, and (iii) includes a push portion which is pushed to contact said fixed contact point; and at least one insulator provided at one of: (i) on said at least one flexible movable contact point at a location that does not overlap with said push portion of said flexible movable contact point, and (ii) on said at least one fixed contact point at a location opposed to said location that does not overlap with said push portion, wherein no insulator is provided in a location coinciding with said push portion.

2. The membrane switch as claimed in claim 1, wherein said insulator is formed by printing.

3. The membrane switch as claimed in claim 2, wherein said insulator has a thickness of not more than 70 μm.

4. The membrane switch as claimed in claim 1, wherein said insulator has a thickness of not more than 70 μm.

5. The membrane switch as claimed in claim 1, wherein the insulator is provided on said flexible movable contact point at a location that does not overlap with said push portion of said flexible movable contact point.

6. The membrane switch as claimed in claim 5, wherein the insulator comprises a plurality of insulator portions, which are provided at a periphery of the flexible movable contact point; and wherein the push portion comprises a center of the flexible movable contact point.

7. The membrane switch as claimed in claim 1, wherein the insulator is provided on said fixed contact point at a location opposed to said location that does not overlap with said push portion.

8. The membrane switch as claimed in claim 7, wherein the insulator comprises a plurality of insulator portions, which are provided at locations corresponding to a periphery of the flexible movable contact point; and wherein the push portion comprises a center of the flexible movable contact point.

9. The membrane switch as claimed in claim 1, wherein the at least one flexible movable contact point comprises a plurality of said flexible movable contact points.

10. The membrane switch as claimed in claim 9, wherein the at least one insulator comprises a plurality of insulators, which are respectively provided on said flexible movable contact points at locations that do not overlap with said push portions of said flexible movable contact points.

11. The membrane switch as claimed in claim 9, wherein the at least one fixed contact point comprises a single fixed contact point corresponding to the plurality of flexible movable contact points.

12. the membrane switch as claimed in claim 11, wherein the at least one insulator comprises a plurality of insulators, which are provided on said fixed contact point so as to correspond respectively to said plurality of flexible movable contact points, at locations opposed to said locations that do not overlap with said push portions.

13. The membrane switch as claimed in claim 9, wherein the at least one fixed contact point comprises a plurality of said fixed contact points, which correspond respectively to the plurality of flexible movable contact points.

14. The membrane switch as claimed in claim 13, wherein the at least one insulator comprises a plurality of insulators, which are respectively provided on said fixed movable contact points at locations opposed to said locations that do not overlap with said push portions.

15. A membrane switch comprising:

a first sheet;

a plurality of fixed contact points provided on a surface of said first sheet;

a second sheet opposed to said first sheet;

a spacer which is provided between the first sheet and the second sheet, and which has a hole that exposes the fixed contact point;

a flexible movable contact point which: (i) is provided on a surface of said second sheet so as to be located entirely within the hole and so as to be opposed to said plurality of fixed contact points via a space, (ii) is movable toward and away from said fixed contact points, and (iii) includes a plurality of push portions, each of which is adapted to be selectively pushed to contact a corresponding one of said fixed contact points; and a plurality of insulators provided on said fixed contact points at locations that are opposed to locations of said movable contact point that do not overlap with said push portions, wherein no insulator is provided in locations coinciding with said push portions.

16. The membrane switch as claimed in claim 15, further comprising an additional insulator which is provided on said flexible movable contact point in between two of said push portions, so as to prevent said two push portions from simultaneously coming into contact with the fixed contact points corresponding thereto.

17. A membrane switch comprising:

a first sheet;

at least one fixed contact point provided on a surface of said first sheet;

a second sheet opposed to said first sheet;

at least one substantially circular flexible movable contact point which: (i) is provided on a surface of said second sheet so as to be opposed to said fixed contact point via a space, (ii) is movable toward and away from said fixed contact point, and (iii) includes a push portion which is pushed to contact said fixed contact point; and at least one insulator which is provided on said substantially circular flexible movable contact point around an entire periphery of said flexible movable contact point, and which includes an opening corresponding to said push portion of said flexible movable contact point.

18. The membrane switch as claimed in claim 17, wherein said opening in said insulator is substantially square.

* * * * *